US005102738A

United States Patent [19]

Bell et al.

[11] Patent Number: 5,102,738

[45] Date of Patent: Apr. 7, 1992

[54] HIGH HYDROHEAD FIBROUS POROUS WEB WITH IMPROVED RETENTIVE ABSORPTION AND ACQUISION RATE

[75] Inventors: Anita S. Bell, Roswell; Bernard Cohen, Berkeley Lake; Michael T. Morman, Alpharetta, all of Ga.

[73] Assignee: Kimberly-Clark Corporation, Neenah, Wis.

[21] Appl. No.: 608,101

[22] Filed: Nov. 1, 1990

[51] Int. Cl.[5] ..... B05D 3/06

[52] U.S. Cl. ..... 428/411.1; 427/39; 427/331; 428/543

[58] Field of Search ..... 427/39, 331; 428/411.1, 428/543

[56] References Cited

U.S. PATENT DOCUMENTS

| | | | |
|---|---|---|---|
| 2,109,333 | 9/1938 | Formhals | 18/8 |
| 2,116,942 | 5/1938 | Formhals | 18/8 |
| 2,123,992 | 7/1938 | Formhals | 18/8 |
| 2,158,416 | 5/1939 | Formhals | 18/8 |
| 2,160,962 | 6/1939 | Formhals | 18/8 |
| 2,168,027 | 8/1939 | Gladding | 18/8 |
| 2,187,306 | 1/1940 | Formhals | 18/8 |
| 2,265,742 | 12/1941 | Norton | 18/8 |
| 2,293,165 | 8/1942 | Norton | 18/8 |
| 2,336,745 | 12/1943 | Manning | 18/8 |
| 3,111,471 | 11/1963 | Evans et al. | 204/168 |
| 3,135,676 | 6/1964 | Rothacker | 204/168 |
| 3,245,896 | 4/1966 | James, Jr. | 204/168 |
| 3,281,347 | 10/1966 | Winder | 204/168 |
| 3,319,309 | 5/1967 | Owens | 28/1 |
| 3,338,992 | 8/1967 | Kinney | 264/24 |
| 3,369,982 | 2/1968 | Wood | 204/168 |
| 3,376,208 | 4/1968 | Wood | 204/168 |
| 3,387,326 | 6/1968 | Hollberg et al. | 18/8 |
| 3,436,797 | 4/1969 | Graf et al. | 28/1 |
| 3,471,597 | 10/1969 | Schirmer | 264/25 |
| 3,481,005 | 12/1969 | Owens et al. | 19/156.4 |
| 3,490,115 | 1/1970 | Owens et al. | 28/1 |
| 3,496,255 | 2/1970 | Erxleben et al. | 264/24 |
| 3,565,979 | 2/1971 | Palmer | 264/24 |
| 3,578,739 | 5/1971 | George | 18/8 |
| 3,689,608 | 9/1972 | Hollberg et al. | 264/24 |
| 3,692,653 | 9/1972 | Drelich et al. | 204/165 |
| 3,754,117 | 8/1973 | Walter | 219/383 |
| 3,880,966 | 4/1975 | Zimmerman et al. | 264/25 |
| 3,904,728 | 9/1975 | Davis et al. | 264/140 |
| 3,973,068 | 8/1976 | Weber | 428/198 |
| 4,013,863 | 3/1977 | van Osenbruggen et al. | 219/69 D |
| 4,024,038 | 5/1977 | Luc | 204/168 |
| 4,197,267 | 4/1980 | Gustavsson | 264/24 |
| 4,208,366 | 6/1980 | Kinney | 264/24 |
| 4,340,563 | 7/1982 | Appel et al. | 264/518 |
| 4,375,718 | 3/1983 | Wadsworth et al. | 29/592 E |
| 4,535,020 | 8/1985 | Thomas et al. | 428/131 |
| 4,623,438 | 11/1986 | Felton et al. | 204/168 |
| 4,663,220 | 5/1987 | Wisneski et al. | 428/221 |

FOREIGN PATENT DOCUMENTS

| | | |
|---|---|---|
| 69-004251 | of 0000 | Japan . |
| 49-035692 | 4/1974 | Japan . |
| 58-180656 | 10/1983 | Japan . |
| 60-094664 | 5/1985 | Japan . |
| 60-235845 | 11/1985 | Japan . |
| 61-146878 | 7/1986 | Japan . |
| 61-168631 | 7/1986 | Japan . |
| 63-211375 | of 1988 | Japan . |
| 63-042016 | 8/1988 | Japan . |
| 1195221 | 6/1970 | United Kingdom . |

OTHER PUBLICATIONS

Catoire et al., "Physico-chemical modifications of superficial regions of low-density polyethylene (LDPE) film under corona discharge", Polymer, vol. 25, p. 766 et seq., Jun., 1984.

Goeller et al., Urination in the First Three Years of Life, Nephron, 28:174–178 (1981).

(List continued a next page.)

*Primary Examiner*—Bernard Pianalto

*Attorney, Agent, or Firm*—Joseph P. Harps

[57] ABSTRACT

A method of treating a high hydrohead fibrous porous web to increase its retentive acquision rate and retentive absorbency, as compared to untreated web, is disclosed.

The invention is also directed to products prepared by or preparable by the process.

26 Claims, 2 Drawing Sheets

OTHER PUBLICATIONS

Griffin, W. C., Classification of Surface Active Agents by "HLB", J. Soc. Cosmetic Chemists, 317-326 (1949).
"A Study of Polyolefin Films and Yarns under Corona Discharge", Catorie, et al., pp. 457 and 469.
"Modification of polypropylene film with corona discharge treatment—improvement of bondability and surface analysis by ESCA", *Shizuoka-ken Kogyo Gijutsu Senta Kenkyu Hokoku,* No. 30 pp. 27-34, (1986). (Abstract only).
"Closer characterization of corona-treated PE surfaces", *Plast.* Eng., vol. 41, No. 12, pp. 45-48, (1985).
"Modification of polypropylene film by corona discharge treatment", *Konbatekku,* vol. 13, No. 7, pp. 8-14, (1985). (No translation).
"Measurement of the surface and the inner charge and their division in corona-charged polypropylene film", *Nanjing* Gogxueyuan Xuebo, No. 3, pp. 121-9, (1984). (Eng. language abstract).
"Chemical characterization of surface-activated polymer films using the ESCA technique", *Physiochem. Aspects Polym. Surf.,* vol. 2, pp. 793-800, (1983).
"Electrical discharge treatment of polypropylene film", *Polymer,* vol. 24, No. 1, pp. 47-52, (1983).
"Corona-discharge treatment of polypropylene films--effects of process parameters", *J. Adhes.,* vol. 11, No. 2, pp. 113-24, (1980).

HIGH HYDROHEAD FIBROUS POROUS WEB WITH IMPROVED RETENTIVE ABSORPTION AND ACQUISION RATE

BACKGROUND OF THE INVENTION

The present invention relates to a method of treating a high hydrohead fibrous porous web material and, for example, to a method that increases the retentive water absorbency of the web. The retentive water acquision rate may also be increased. As used herein the term "absorbency" generally refers to the ability of a material to acquire a fluid and the acquision rate refers to the rate of such acquision. An example of a use where high absorbency and high acquision are desired would be wiper type materials. In addition to having the characteristics of high absorbency and high acquision rate, wipers desirably also should have the characteristics of high retentive absorbency and high retentive acquision rate. The term retentive acquision rate is used herein to designate comparison of the rate of acquision of a fluid by a material when the material is first used to acquire the fluid as compared to the second, third and fourth times the material is used to acquire the fluid. Improved retentive acquisition rate is evidenced by by smaller decreases in the rate of acquisition with multiple uses. Likewise, the term retentive absorbency is used to designate comparison of the amount of fluid acquired by a material when the material is first used to acquire the fluid as compared to the amount of fluid acquired when the material is used a second, third, fourth time to acquire the fluid. Improved retentive absorbency is evidenced by smaller decreases in the amount of fluid absorbed by the material with multiple uses. In other words, the ability of the material to reabsorb fluid after having, in our test, been exposed to fluid, wrung out and allowed to dry.

In the copending, concurrently filed application Ser. No. 07/608,103 of Bernard Cohen and Michael T. Morman entitled Low Hydrohead Fibrous Porous Web with Improved Retentive Wettability the inventors disclose that the application of corona discharge treatment to low hydrohead webs whose surface includes a surface active agent having a hydrophile-lipophile balance of 6 or greater results in a significant increase in the retentive wettability, as defined therein, of such webs. This application is hereby incorporated by reference. Low hydrohead webs of that type would generally be unsatisfactory for use as a wiper material due to their open pore structure which would greatly reduce the ability of the web to acquire fluids. Conversely, high hydrohead webs, as defined herein, would generally be undesirable for use in applications where rapid transmission of large amounts of fluid through the material is desired. This undesirability arises from the generally tight, closed pore structure of high hydrohead materials. Such pore structure would inhibit the passage of fluids therethrough in rapid fashion.

In the past, hydrophobic wipers have been subjected to treatment with surfactants to improve their characteristics. The wipers have been treated with surfactant by (1) passing the formed wiper through a bath containing the surfactant in either neat or solution form and drying the wiper as needed so that a given amount of the surfactant is deposited on the wiper, or (2) spraying a surfactant in either neat or solution form on the fibers as they are being formed or on the fibrous porous web and drying the wiper as needed so that a given amount of the surfactant is deposited on the wiper, or, (3) adding surfactant to a thermoplastic resin prior to extrusion and formation of the resin into a thermoplastic porous web material. In the later situation, under known process conditions, the added surfactant exudes or migrates to the surface of the fibres of the porous web material during or shortly after fiber formation. This phenomenon has been referred to as "blooming" the surfactant. It is believed that blooming results from the insolubility of the surfactant in the thermoplastic polymer as the polymer cools. See U.S. Pat. No. 4,535,020 to Thomas et al (hereafter Thomas et al 020) which demonstrates surfactant blooming in a diaper liner formed from a perforated film.

A wiper made from a hydrophobic material, such as a thermoplastic polymer, will not readily acquire or absorb spilled fluids because the surface tension of the fluid is greater than the critical surface energy of the hydrophobic material. Surface tension is the contractile surface force of a fluid where the fluid tries to assume a spherical form and to present the least possible surface area. It is usually measured in dynes per centimeter. Accordingly, because of its effect on the insulating fluids, surfactant has been previously applied to wipers. Application of a surfactant onto a wiper material may make a nonabsorbing wiper absorbent by at least two mechanisms: (1) Surfactants present on the wiper can dissolve into a fluid and lower the surface tension of the resulting solution to more equal the critical surface energy of the wiper material. Accordingly, when a surfactant coated wiper is used to wipe up a fluid such as water, the surfactant acts to lower the surface tension of the fluid and allow the fluid to be acquired at a faster rate and for a larger amount of fluid to be absorbed into the wiper. In this situation, a certain amount of the surfactant on the wiper is lost with each wiping and wringing and unacceptable acquision rate and absorbency occurs at some following wiping due to the lack of availability of surfactant to lower the surface tension of the fluid. (2) The surfactant can be coated onto the fibers making up the wiper, making the fiber surface of the wiper more hydrophilic, i.e., increase the apparent critical surface energy of the fibers. In this situation the wiper would have permanent absorbency if the surfactant did not dissolve in the fluid the wiper was used to pick up.

As any anyone will testify, it is an aggravating event when a disposable wiper fails in its appointed task of rapidly acquiring and absorbing a fluid spill.

Accordingly, it has been a goal of those in the art to provide a high hydrohead porous web wiper material which has an improved acquision rate and absorbency. This was the initial goal because, if the material cannot acquire and absorb fluid at all, the material cannot function as a wiper. Additionally, it has been a goal of those in the art to provide a high hydrohead porous web wiper material which has an improved retentive acquision rate and improved retentive absorbency. That is, when dried and wrung-out between wipings, the wiper has a significant increase in the number of times it can be used to absorb fluid. This goal is desirable not only from the standpoint of allowing a given disposable wiper to be used more times but also from an environmental standpoint in that fewer wipers will be disposed into the environment.

Corona discharge treatment of films is old in the art and it is known that corona discharge treatment of a polymer film in the presence of air entails substantial morphological and chemical modifications in the polymer film's surface region. See Catoire et al, "Physicochemical modifications of superficial regions of low-density polyethylene (LDPE) film under corona discharge," *Polymer*, vol. 25, p. 766, et. seq, June, 1984.

Generally speaking, corona treatment has been utilized to either (1) improve the print fastness on the film, or (2) to perforate the film. For example, U.S. Pat. No. 4,283,291 to Lowther describes an apparatus for providing a corona discharge, and U.S. Pat. No. 3,880,966 to Zimmerman et al discloses a method of using a corona discharge to perforate a crystalline elastic polymer film and thus increase its permeability. U.S. Pat. No. 3,471,597 to Schirmer also discloses a method for perforating a film by corona discharge. U.S. Pat. No. 3,754,117 to Walter discloses an apparatus and method for corona discharge treatment for modifying the surface properties of thin layers of fibers which improve the adhesion of subsequently applied inks or paints or of subsequent bonding.

It also is possible to treat a diaper liner material with a corona discharge and then immediately dip the film in a surfactant solution. Because the corona effect on the material generally starts to immediately decay, it is important to get the corona treated material into the bath as quickly as possible. Such a method is discussed in Japanese KOKAI Patent Number SHO63[1988]-211375. This document discloses a method for producing a nonwoven fabric having a long lasting hydrophilicity. The method involves first treating a nonwoven fabric of synthetic fiber by a corona discharge and then coating the treated fabric with about 2-10 grams per square meter of fabric of surface active agent.

Of particular interest is the fact that Thomas et al 020 is directed to the utilization of corona discharge in conjunction with surfactant treated films to effect improved wettability, i.e. higher fluid transmission rates and therefore decreased run-off of fluid. In this regard Thomas et al 020 states that a perforated film which has been treated with surfactant and which is then corona discharge treated results in a film with very low, zero or near zero fluid run-off on the first run-off test. Thomas et al 020 reports that this effect is accomplished because the corona discharge treatment acts on the chemical additive, the surfactant, to provide the perforated film with a zero or near zero percent run off. Thomas et al 020 postulates that this effect is achieved due to the surfactant providing a greater polarizability to the film then the film would have without the surfactant being added. The corona discharge treatment provides additional polarizing effect and, in combination with the surfactant, provides improved wettability. Because Thomas et al 020 is directed toward use of the perforated film as a diaper liner, it does not appear to address the questions of acquision rate and absorbency. Acquision rate, as defined herein, usually does not apply to a film and diaper liners are generally designed to be permeable to fluids as opposed to absorbing them. Lastly, Thomas et al 020 does not appear to address retentive capabilities at all because the testing reported therein is directed to one-time exposure to fluid.

In view of the forgoing, and the discovery by Messers, Cohen and Morman that treating a low hydrohead porous web with a surface active agent having a hydrophile-lipophile balance of about 6 or greater followed by corona discharge treatment yielded significantly improved retentive wettability values for the material, we decided to determine if such treatment had advantageous effects on the retentive water acquision rate and retentive water absorbency of high hydrohead porous webs. If such was the case an improved wiper would result.

SUMMARY OF THE INVENTION

In response to the above, we have devised a method of treating a high hydrohead fibrous porous web material to increase the web's retentive water acquision rate (averaged normalized rate of water absorption in subsequent reabsorptions as compared to the initial absorption rate) and retentive water absorbency (average normalized amount of water absorbed in subsequent reabsorptions as compared to the amount initially absorbed). The method generally includes the steps of: (1) providing a high hydrohead fibrous porous web having a surface concentration of at least about 0.05 percent, by weight of the web, of a surface active agent having a hydrophile-lipophile balance of at least about 6; and (2) applying a corona discharge equivalent to a charge of at least about 0.8 watt minute per square foot per side of the web to the surface active agent bearing web. The resultant web will have a percent decrease in the averaged normalized water absorbed, at two minutes, of less than about 50 weight percent in each of the second, third and fourth times the material is tested in accordance with absorbency test A when compared to the averaged normalized water absorbed upon being initially tested in accordance with absorbency test A. In some embodiments, the web will have an average absorbency decrease, as defined above, of less than about 25 percent.

In some embodiments the resultant web will have a percent decrease in the averaged normalized water absorbed, at one minute, of less than about 50 weight percent in each of the second, third and fourth times the material is tested in accordance with absorbency test A when compared to the averaged normalized water absorbed upon being initially tested in accordance with absorbency test A. Additionally, in some embodiments, the resultant web will have a percent decrease in the averaged normalized water absorbed, at one minute, of less than about 25 weight percent in each of the second, third and fourth times the material is tested in accordance with absorbency test A when compared to the averaged normalized water absorbed upon being initially tested in accordance with absorbency test A.

The treated webs generally also have improved retentive averaged normalized rates of water absorption. Thus, generally, the resulting webs have a percent decrease in the averaged normalized rate of water absorbed, in the first 2.4 seconds of absorption, of less than about 50 percent in each of the second, third and fourth times the material is tested in accordance with absorbency test A when compared to the averaged normalized rate of water absorbed upon being initially tested in accordance with absorbency test A. For example, the webs may have such improved retentive averaged normalized rates of water absorption that the averaged normalized rate of water absorbed, in the first 2.4 seconds of absorption, decreases less than about 25 percent in each of the second, third and fourth times the material is tested in accordance with absorbency test A when compared to the averaged normalized rate of water absorbed upon being initially tested in accordance with absorbency test A. Even more particularly, the webs may have such improved retentive averaged normalized rates of water absorption that the averaged normalized rate of water absorbed, in the first 2.4 seconds of absorption, decreases less than about 10 percent in each of the second, third and fourth times the material is tested in accordance with absorbency test A when compared to the averaged normalized rate of water absorbed upon being initially tested in accordance with absorbency test A.

From about 0.05% to about 3%, by weight of the web material, of surface active agent may be adhered to the web material. For example, from about 0.1% to about 1%, by weight of the web material, of surface active agent may be adhered to the web material. More particularly, from about 0.1% to about 0.4%, by weight of the web material, of surface active agent may be adhered to the web material. Even more particularly, from about 0.2% to about 0.3%, by weight of the web material, of surface active agent may be adhered to the web material.

The equivalent of from about 0.8 to about 15 watt minute per square foot per side of the web material of corona discharge may be applied to the web material. For example, the equivalent of from about 1 to about 10 watt minute per square foot per side of the web material of corona discharge is applied to the web material. More particularly, the equivalent of from about 2 to about 8 watt minute per square foot per side of the web material of corona discharge is applied to the web material.

In one embodiment our process includes the steps of (1) forming a melt from a thermoplastic fiber forming material; (2) adding, to the melt, an amount of surface active agent having a hydrophile-lipophile balance of at least about 6 sufficient to effect a surface concentration of the surface active agent of at least about 0.05%, by weight of the resulting fibrous porous web material; (3) forming the melt into fibers and the fibers into a high hydrohead fibrous process web under conditions which allow at least 0.05%, by weight of the fibrous porous web, of the surface active agent to bloom to the surface of the fibers of the porous web; and (4) applying a corona discharge equivalent to a charge of at least about 0.8 watt minute per square foot of the porous web to the surface active agent bearing web material.

Because not all of the surface active agent added to the melt blooms, the amount of surface active agent added to the melt is generally greater than the amount desired to be present on the surface. Accordingly, the amount of surface active agent added to the melt may vary with the surface active agent used, the thermoplastic material used to form the web and/or the process conditions of forming the web.

As is the case generally, in this embodiment the equivalent of from about 0.8 to about 15 watt minute per square foot of the web material of corona discharge may be applied to the web material. For example, the equivalent of from about 1 to about 5 watt minute per square foot of the web material of corona discharge is applied to the web material. More particularly, the equivalent of from about 2 to about 4 watt minute per square foot of the web material of corona discharge is applied to the web material.

In all embodiments the surface active agent may be selected from the group including one or more wetting agents, emulsions and dispersants.

In all embodiments the hydrophile-lipophile balance of the surface active agent will be about 6 or greater. For example the hydrophile-lipophile balance may range from 6 to about 20. More particularly, the hydrophile-lipophile balance of the surface active agent may range from 8 to about 20. Even more particularly, the hydrophile-lipophile balance of the surface active agent may range from 10 to about 20.

The present invention is also directed to products prepared by or preparable by our process. That is, the invention is generally directed to a fibrous porous web which has a high hydrohead when tested in accordance with Test A prior to surfactant and corona treatment in accordance with our invention and which has improved retentive averaged normalized absorbency and improved retentive averaged normalized water acquision rates after surfactant and corona treatment.

The fibrous porous web material may include a polyolefin or a blend of polyolefins or any other suitable material which may be formed into a fibrous porous web. For example, the fibrous porous web may be formed from polyethylene or polypropylene.

The fibrous porous web material may be formed by any of the wide variety of processes which provide a high hydrohead fibrous porous web. For example, the fibrous porous web may be formed by meltblowing so that the fibrous porous web includes meltblown fibers.

OBJECTS OF THE INVENTION

Accordingly, it is a general object of the present invention to provide a method whereby the retentive averaged normalized water absorbency of high hydrohead porous webs is improved.

Another general object of the present invention is to provide a high hydrohead fibrous porous web material having an increased retentive averaged normalized rate of water acquision.

Still further objects and the broad scope of applicability of the present invention will become apparent to those of skill in the art from the details given hereinafter. However, it should be understood that the detailed description of the presently preferred embodiments of the present invention is given only by way of illustration because various changes and modifications well within the spirit and scope of the invention will become apparent to those of skill in the art in view of the following description.

DEFINITIONS AND TESTS

Figure 1:
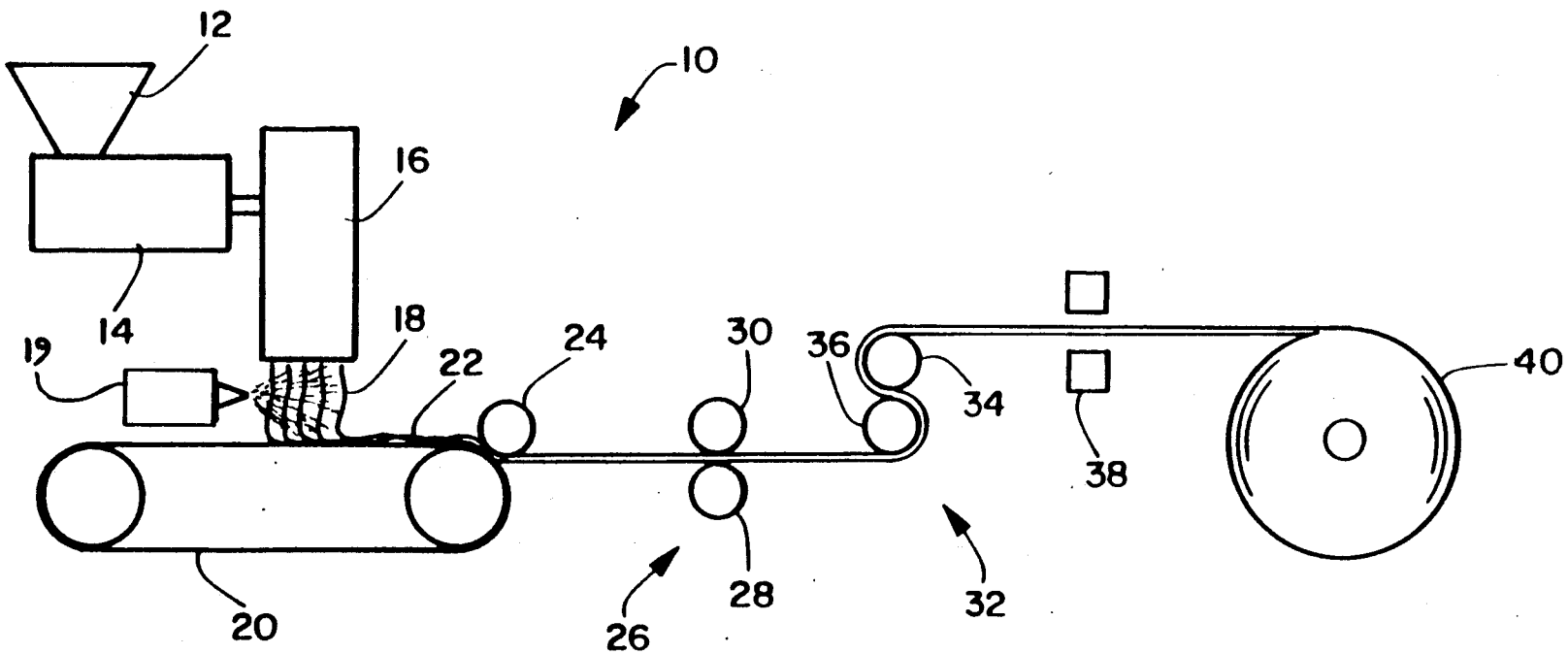
FIG. 1 is a schematic representation of one process for carrying out the present invention.

As used herein the term "high hydrophile-lipophile balance" refers to a surface active agent having a hydrophile-lipophile balance of about six (6) or greater.

As used herein the term "surface active agent" refers to any compound that reduces surface tension when dissolved in water or water solutions or which reduces interfacial tension between two liquids, or between a liquid and a solid. There are three general categories of surface active agents: detergents, wetting agents (i.e. surfactants) and emulsifiers.

The term "hydrophile-lipophile balance" (HLB) is well known to those in the art. The HLB of a nonionic surfactant is the approximate weight percent of ethylene oxide in the surfactant divided by 5. The numerical scale of HLB values ranges from 1 (completely lipophilic or oil-loving) to 20 (completely hydrophilic or water-loving). Refer to W. C. Griffin, *J. Soc. Cosmetic Chemists* 317-326 (1949). In some instances the HLB of a material is determined by comparing its activity to known materials having known HLB's.

As used herein the term "high hydrohead material" refers to a porous web material which supports more than about 25 centimeters of water when its hydrohead is measured in accordance with Method 5514—Federal Test Methods Standard No. 191A. In all cases the hydrohead of the porous web material is determined by measurement either before the web has been treated with surface active agent and corona discharge as is required by the present invention or, if such is not possible, after extraction of the surface active agent from the web.

As used herein the term "water absorbency" refers to the amount, in grams, of water that a three inch by eight inch sample (folded as described in Test A, below) of high hydrohead porous web material can vertically acquire within a given amount of time.

As used herein the term "normalized water absorbency" refers to the calculated amount, in grams, of water per gram of web that a one gram sample of high hydrohead porous web material can vertically acquire within a given amount of time. This value is calculated by multiplying the "water absorbency" value for a given time period of (1/the weight of the sample).

As used herein the term "averaged normalized water absorbency" refers to the average of thee "normalized water absorbency" replicates of the material treated in accordance with out invention. In the example, the "averaged normalized water absorbency" value of the non-corona treated material was attained by averaging four replicates.

As used herein the term "rate of water absorbed" (rate) refers to the rate, in grams per second, of vertical water acquision of a three inch by eight inch sample (folded as described in Test A, below) of high hydrohead porous web material within a given amount of time.

As used herein the term "normalized rate of water absorbency" refers to the calculated rate, in reciprocal seconds, that a one gram sample of high hydrohead porous web material can vertically acquire within a given amount of time. This value is calculated by multiplying the "rate of water absorbed" (rate) value for a given time period by (1/the weight of the sample, in grams).

As used herein the term "averaged normalized rate of water absorbed" refers to the average of three "normalized rate of water absorbed" replicates of the material treated in accordance with our invention. In the example, the "averaged normalized rate of water absorbed" value of the non-corona treated material was attained by averaging four replicates.

All absorbency and rate of acquision data given herein were obtained through the use of Water Absorbency Test A, hereinafter Test A. The purpose of absorbency Test A is to quantitatively measure the absorbency and rate of acquision properties of a porous fibrous web such as a nonwoven web.

Test A requires the following materials/equipment: (1) samples of materials to be tested cut in 3 inch by 8 inch size; (2) staples; (3) distilled water; (4) one 250 ml. beaker; (5) one small lab jack; (6) an Instron model 1122 with strip recorder; (7) a Lab Wringer, a #LW838 Atlas Electric Devices Co. of Chicago, Ill., was used by us; (8) one 500 gram load cell for the Instron nd (9) one standard ten gram weight.

Sample preparation for Test A is as follows: (1) 3 inch by 8 inch samples of the material to be tested are obtained; (2) the sample is folded in on itself lengthwise one inch from one side; (3) the sample is folded in on itself lengthwise one inch from the other side to produce a three ply 1 inch by 8 inch sample; (4) the sample is folded widthwise in half; and (5) the sample is stapled one-eigth of an inch from the widthwise fold. The resultant sample is a butterfly configuration with each "wing" having three plies of sample material.

In order to conduct Test A, the Instron must first be prepared. This is done by installing the 500 gram load cell in the Instron and calibrating the machine with the 10 gram weight. The strip recorder should read 0 to 10 rams (1 inch per gram). Next the lower jaws are removed from the Instron and replaced with a lab jack. The beaker which is filled with distilled water is placed on the lab jack. The side of the beaker is marked to record the height of the water in the beaker. It is important that this level be maintained at as constant a level as possible.

Placement of a sample in the Instron should be consistent and is accomplished as follows: (1) a start-up sample is placed in the upper jaws of the Instron with the stapled end down; (2) the lab jack is used to raise the beaker so that the level of the water will be one-eighth inch above the stable (the folded edge of the sample will be one-fourth inch below the surface of the water); and (3) the height of the jack is recorded. It is important that the beaker be raised to the same height for each test.

Sample testing is accomplished as follows: (1) a sample to be tested is placed in the jaws of the Instron as stated above; (2) the strip recorder of the Instron is started and allowed to run for ten seconds to obtain a reading of the sample weight; (3) the level of fluid in the beaker is checked to ensure that it is at the mark that has been placed on the beaker; (4) the lab jack is used to raise the sample to the same height as was recorded with the start-up sample [this step should be done quickly and smoothly to minimize irregularities in the climbing portion of the curve]; (5) the test is allowed to proceed for three minutes: a chart speed of 5 inches per minute was used in all cases; (6) once the three minutes has elapsed, the recorder is turned off, the lab jack is used to lower the beaker and the sample is removed from the jaws of the Instron; (7) the staple is carefully removed from the sample but the sample is maintained in its six-ply configuration; (8) a lab wringer is used to remove excess water from the sample; [30 pounds added to the wringer arm is adequate] (9) after the sample is put through the wringer, it is unfolded and allowed to dry [5 hours is ample for a 2 ounce per square yard meltblown sample].

The data obtained in test A are as follows: (1) total sample weight is the value read from the baseline of the Instron recorder plot. [The scale of the paper in these tests was 1 inch per gram with a zero to ten gram range.]; (2) actual sample weight is the value calculated to be the total sample weight minus the weight of the staple used to hold the sample fold intact; (3) the water absorbed value is read as the gram weight absorbed amount recorded at 1.2 seconds, 2.4 seconds, 1 minute and 2 minutes of elapsed time. Early points are used to calculate acquision rate; later points are used to compare overall absorption capacity. Total water absorbed is calculated to be the difference between the baseline total sample weight and the weight read from the curve for a given time. [Note: If the weight on the curve is less than the baseline weight, the amount of water absorbed is recorded as zero. This occurs as the result of a buoyant effect as the acquision rate decreases.] (4) the rate is the value of the slope of the climbing portion of the curve and is calculated by linear regression using water absorbed readings for early points, i.e. "the points (0 sec., 0 grams), (1.2 sec., $Y_1$ grams) and (2.4 sec., $Y_2$ grams). Note that $Y_1$=water weight at 1.2 seconds (weight absorbed at 1.2 seconds minus total sample weight) and $Y_2$=water weight at 2.4 seconds (weight absorbed at 2.4 seconds minus total sample weight).

All data have also been normalized and given in terms of grams of water absorbed per gram of tested material. Actual sample weight were used in these calculations.

As used herein the term "decrease in averaged normalized rate" reefers to the percentage decrease in the rate of water absorption of a given sample in its second, third, and fourth times of testing, in accordance with Test A, as compared to the rate of water absorption calculated in its first time of testing when done in accordance with test A. Any increase in the rate is reported as a zero decrease.

As used herein the term "decrease in averaged normalized water absorbed" refers to the percentage decrease in the amount of water absorbed by a given sample in its second, third, and fourth times of testing, in accordance with Test A, as compared to the amount of water absorption calculated in its first time of testing when done in accordance with test A. For consistency, the point in time of measurement of the amount of water absorbed must be the same. Thus, this data can be reported at, for example, one minute, two minutes or any other convenient time. The values are reported at 1 and 2 minutes herein.

DETAILED DESCRIPTION OF THE PREFERRED EMBODIMENT

Referring now to the drawings where like reference numerals represent like structure or like process steps and, in particular, to FIG. 1 which schematically illustrates apparatus 10 for forming and treating a high hydrohead fibrous porous web material to improve the retentive water absorbency and retentive water acquision rate of the material. The process may be initiated by supplying pellets (not shown) of a fiber-forming thermoplastic material which may be, for example, a polyolefin or a blend of polyolefins such as polypropylene or polyethylene into the hopper 12 of an extruder 14.

While any thermoplastic fiber forming material may be useful, one desirable material is a polypropylene which may be obtained from the Shell Chemical Company under the trade designation 5A09. The Shell 5A09 polypropylene has a melt flow rate of about 40 decigrams per minute when measured in accordance with ASTM D 1238 at 230 degrees Centigrade.

Many other thermoplastic polymers are suitable for use as the fiber forming polymer. Specific, non-limiting examples of such polymers include: polyolefins such as low density polyethylene, linear low density polyethylene and high density polyethylene. The materials may be plasticized with suitable plasticizers, and other additives known in the art may be added to achieve the desired physical characteristics.

Elastomeric polymers may be used to form the fibrous porous web. Such polymers include: polyester elastomeric materials, polyurethane elastomeric materials, polyetherester elastomeric materials, polyamide elastomeric materials, and the various elastomeric A-B-A' block copolymer materials disclosed in U.S. Pat. No. 4,663,220 to Wisneski et al, which is hereby incorporated by reference.

Neat or a solution of a surface active agent is sprayed onto the fibers as they are formed or on the formed web 22 from a spraying apparatus which may be a spray boom 19. The surface active agent may be, for example, an emulsion, a wetting agent or a detergent having a hydrophile-lipophile balance at a least about 6 or greater. The surface active agent may be nonionic, cationic or anionic. If the surface active agent is nonionic, it is desirable that it have at least 3 ethylene oxide groups. One desirable surface active agent is a surfactant is Na-di-(2-ethlyhexyl) sulphosuccinate which may be obtained from American Cyanamide under the trade designation Aerosol OT. Aerosol OT has an equivalent hydrophile-lipophile balance of greater than about 13. It has been reported that the hydrophile-lipophile balance of Aerosol OT is about 13.5. See, U.S. Pat. No. 4,013,863 to van Osenbruggen, et al. at Table I, therein, and U.S. Pat. No. 3,904,728 to Davis, et al. Another surface active agent which may be used may be obtained from the Rohm & Haas Company under the trade designation Triton X-102. Rohm & Haas literature states that the X-102 is a nonionic ocytlphenol liquid surfactant having from 12–13 ethylene oxide units. The material is about 73%, by weight, ethylene oxide, has a Brookfield viscosity at 25 degrees C. (12rpm) of 30, and has a calculated hydrophile-lipophile balance of about 14.6. Other Triton brand name materials may be utilized in the present invention. Exemplary of which are Triton X-35 which is a nonionic octylphenol series material having three ethylene oxide units and a calculated hydrophile-lipophile balance of 7.8; Triton RW 50 which is a cationic material, ($t\text{-}C_{12\text{-}14}NH(CH_2CH_2O)_5H$), having an average of five ethylene oxide units and a measured hydrophile-lipophile balance of 12–14 Triton RW 100 which is a cationic material, ($t\text{-}C_{12\text{-}14}NH(CH_2CH_2O)_{10}H$), having an average of 10 ethylene oxide units and a measured hydrophile-lipophile balance of 16; Triton DF 12 which is a nonionic modified polyethoxylated alcohol that has a calculated hydrophile-lipophile balance of 10.6 and Triton DF 18 which is a nonionic biodegradable modified alcohol that has a calculated hydrophile-lipophile balance of 11.3.

It is desirable for the surface concentration of the surface active agent on the surface of the fibers of the web to be at least about 0.05 weight percent of the web. For example, from about 0.05 percent, by weight, to about 3 percent, by weight of the web. More particularly, from about 0.10 percent, by weight, to about 1.0 percent, by weight of the web. For example, from about 0.1 percent, by weight, to about 0.4 percent, by weight, of the web. Even more particularly, from about 0.20 percent, by weight, to about 0.30 percent by weight of the web. In one embodiment the surface concentration is about 0.30 percent by weight of the web 22.

Because not all of the sprayed surface active agent remains on the fibers, the amount of surface active agent applied to the fibers is generally greater than the amount desired to be present on the surface. Accordingly, the amount of surface active agent sprayed on the fibers may vary with the surface active agent used, the thermoplastic material used to form the web and/or the process conditions of forming the web.

The temperature of the blend is elevated within the extruder 14 by a conventional heating arrangement (not shown) to melt the polymer and pressure is applied to the polymer by the pressure-applying action of a turning screw (not shown), located within the extruder, to form the polymer into an extrudable composition. Preferably the polymer is heated to a temperature of at least about 175 degrees Centigrade if polypropylene is utilized as the fiber forming polymer. The polymer is then forwarded by the pressure applying action of the turning screw to a fiber forming arrangement 16 which may, for example, be a conventional meltblowing die arrangement. Meltblowing die arrangements are described in U.S. Pat. Nos. 3,978,185 to Buntin et al and 3,849,241 to Buntin et al. Both of these patents are hereby incorporated by reference. The elevated temperature of the polymer is maintained in the fiber forming arrangement 16 by a conventional heating arrangement (not shown). The fiber-forming arrangement generally extends a distance in the cross-machine direction which may be about equal to the width of the fibrous porous nonwoven web which is to be formed by the process. The fiber-forming arrangement 16 extrudes and attenuates the fibers 18 and directs them onto a moving forming screen 20. Upon impacting the forming screen 20, the fibers 18 may, depending upon known process conditions, adhere to each other to form the fibrous porous web 22. If not, a nip roller 24, in combination with the forming screen 20 can act to make the web 22 self supporting. If desired, the web 22 may be passed through a thermal point bonding arrangement 26 including rollers 28 and 30 to consolidate the web 22 even further. The combination of elevated temperature and elevated pressure conditions which effect extrusion of the polymer will vary over wide ranges. For example, at higher elevated temperatures, lower elevated pressures will result in satisfactory extrusion rates and, at higher elevated pressures of extrusion, lower elevated temperatures will effect satisfactory extrusion rates.

During or shortly after formation of the fibrous porous web 22, the high hydrophile-lipophile surface active agent is sprayed onto the surface of the fibers forming the web 22. In many instances the heat of the molten fibers 18 cooling after extrusion will be sufficient to effect drying of the high hydrophile-lipophile balance surface active agent. However, in some instances, the web 22 will have to be passed through a heating arrangement 32 which can include heating cans 34 and 36 to effect drying. The heating can drying temperature will vary with the surface active agent and polymer utilized. In any event the drying conditions are to be adjusted so that at least about 0.05, weight percent of the resultant web 22, of surface active agent will be on the surface of the web 22. For example, from about 0.05 percent, by weight, to about 3 percent, by weight of the web 22 of surface active agent will be on the surface of the web 22. More particularly, from about 0.10 percent, by weight, to about 1.0 percent, by weight of the web 22, of surface active agent will be on the surface of the web 22. For example, from about 0.1 percent, by weight, to about 0.4 percent, by weight, of the web 22, of the surface active agent will be on the surface of the web 22. Even more particularly, from about 0.20 percent, by weight, to about 0.30 percent by weight of the web 22, of surface active agent will be on the surface of the web 22.

Determination of the weight percentage of the surface active agent on the surface of the web at this point in the process can be determined by: (1) weighing the initial sample of material; (2) quantitatively extracting the surface active agent from the surface of the web 22 using an appropriate solvent; (3) determining the amount of surface active agent in the extraction solvent by such means as ultraviolet spectroscopy, infra-red spectroscopy, gravimetric analysis etc. (This may require making up a series of concentration standards of the surface active agent in the extracting fluid to calibrate the analytical equipment/method/technique. Manufactures of surface active agent often will supply methods for determining surface active agent quantitatively and qualitatively.); and (4) dividing the amount of surface active agent by the initial web 22 sample weight and multiplying by 100.

Once the high hydrophile-lipophile balance surface active agent has been applied to the surface of high hydrohead the web 22, the web 22 is passed through the gaps of two conventional corona discharge units 38. The two corona units are arranged so one treats one side of the web 22 and the other corona unit treats the other side of the web 22. One desirable corona discharge unit can be obtained from Enercon Ind. Corporation under trade designation Model SS 1223. The gaps of the corona discharge treatment apparatus may be maintained at about 0.065 inches. Standard metal rolls are used as the ground electrode. The base metal ground electrode roll may be buffered with 1 wrap of 0.5 mil polyester to substantially prevent arcing of the corona unit and pinholing in the high hydrohead fibrous porous web 22. Such buffering reduces the effectiveness of the corona discharge unit by approximately 20% for each wrap of 0.5 mil film used. The line speed of the high hydrohead web material 22 and the voltage and amperage of the corona discharge unit 38 are adjusted so that the equivalent of at least about 0.8 watt minute per square foot per side of corona discharge is applied to the web material 22. For example, the equivalent of from about 0.8 to about 15 watt minute per square foot per side of the web material 22 of corona discharge may be applied to the web material 22. Accordingly, the equivalent of from about 1 to about 10 watt minute per square foot per side of the web material 22 of corona discharge may be applied to the web material 22. More particularly, the equivalent of from about 2 to about 8 watt minute per square foot per side of the web material 22 of corona discharge may be applied to the web material 22.

Once the corona discharge unit 38 has applied the appropriate amount of charge to the web material 22, the web material 22, may be wound up on a storage roll 40. The corona treated web material 22 may later be used in a wide variety of applications which require or desire utilization of a material having acceptable retentive water absorbency and retentive water acquision rates. This method of treating a high hydrohead fibrous porous web material 22 has been found to increase the web's retentive acquision rate (averaged normalized rate of water absorption in subsequent reabsorptions as compared to the initial absorption rate) and retentive absorbency (averaged normalized amount of water absorbed in subsequent reabsorptions as compared to the amount initially absorbed).

Figure 2:
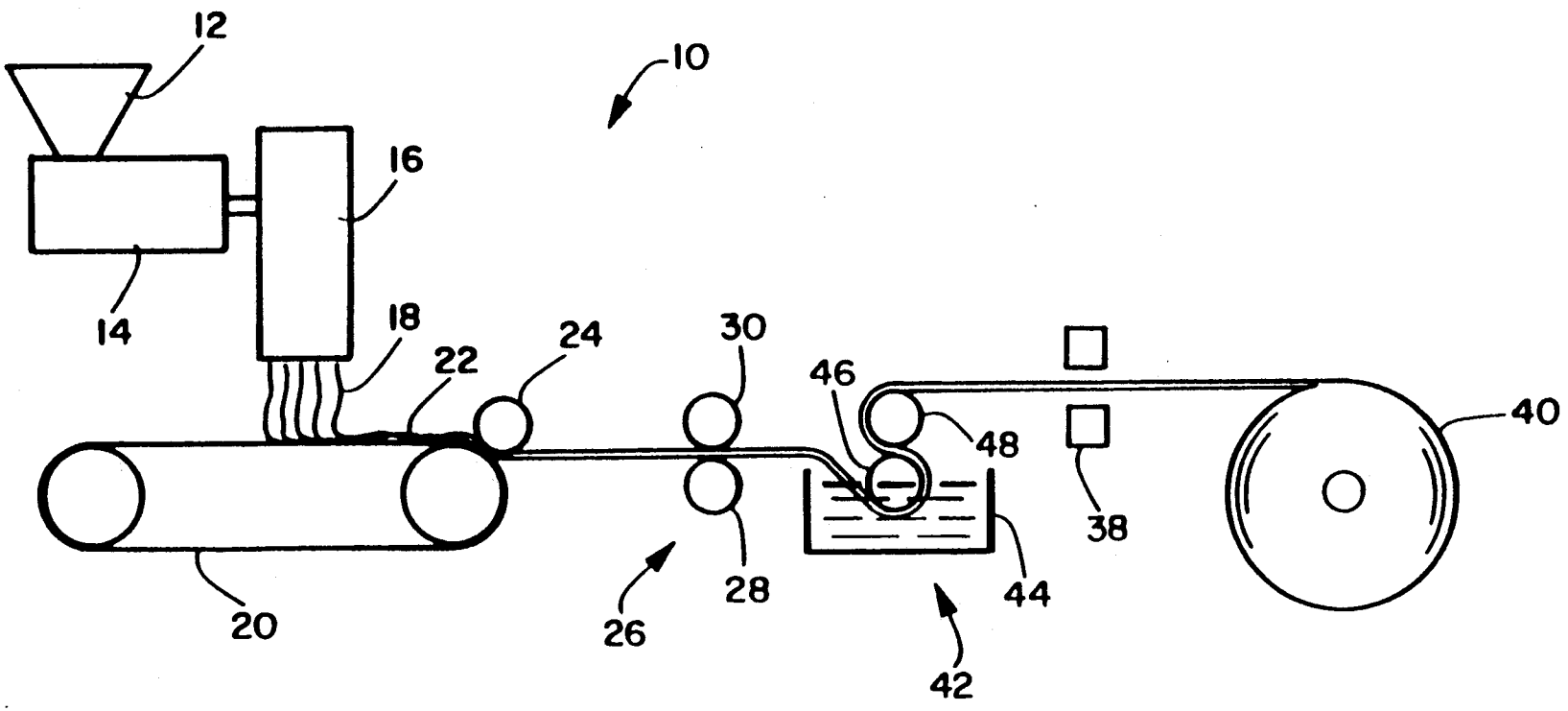
FIG. 2 is a schematic representation of a second process for carrying out the present invention.

Another embodiment is schematically illustrated in FIG. 2. In this situation the surface active agent may be applied in neat form or from solution by any of a number of conventional application methods. Exemplary of which is dip-and-squeeze. The dip-and-squeeze method is illustrated in FIG. 2 with the dip-and-squeeze apparatus 42 including a dipping bath 44 and a pair of squeezing rollers 46 and 48. In this process at least about 0.05%, by weight, of the web material 22 of high hydrophile-lipophile balance surface active agent is applied to the web material 22. For example, from about 0.05% to about 3%, by weight of the two web material, of high hydrophile-lipophile balance surface active agent may be applied to the web material 22. Even more particularly, from about 0.1% to about 1%, by weight of the web material 22, of high hydrophile-lipophile balance surface active agent may be applied to the material 22. More particularly, from about 0.1% to about 0.4%, by weight of the web material 22, of high hydrophile-lipophile balance surface active agent may be applied to the web material 22. Even more particularly, from about 0.2% to about 0.3% by weight of the web material 22, of high hydrophile-lipophile surface active agent may be applied to the web material 22. The remainder of the process is the same as the process described with respect to FIG. 1.

Of course, other conventional methods can be used for the production of the nonwoven web 22.

EXAMPLE

In order to demonstrate the improved retentive water absorbency and improved retentive water acquision rate of corona discharge treated high hydrophile-lipophile balance web materials of our invention, samples of commercially available wet wipers available from the Kimberly-Clark Corporation under the trademark Kimtex were treated in accordance with the teachings of the present invention. The wiper material was an approximate 2 ounce per square yard meltblow polypropylene material which had already been treated with a sufficient amount of Aerosol OT, Na-di(2-ethlyhexyl) sulphosuccinate, to have a surface concentration of Aerosol OT of about 0.30 weight percent of about 0.006 ounce per square yard. This web material was subjected to corona discharge treatment in accordance with our invention. The amount of corona discharge applied to the sample was varied by varying the line speed of the web material as it moved through the gaps of each of the two corona discharge electrodes. Each of the two electrodes were three feet in length and had their gap set at 0.065 inch and the power supply was set at 1.25 kilowatts for each of the two electrodes. The ground roll of each electrode was buffered with one wrap of 0.5 mil polyester to prevent arcing and pinholing. As has been previously stated this buffering reduces the effectiveness of the corona discharge by about 20 percent. Samples were made with the line speed (1s) of the web set a 25, 50, 100, 300, 400 and 600 feet per minute. The corresponding watt-min per square foot per side of corona discharge values are 13.3, 6.6, 3.3, 1.1, 0.83 and 0.55, respectively. For example, the corona charge placed on each side of the 400 feet per minute sample can be calculated as follows: 1250 watts per side times 0.80 efficiency divided by three feet electrode length divided by 400 feet per minute equals 0.83 watt min. per square foot per side.

Testing of these materials and samples of non-corona treated material was conducted in accordance with Test A. The results of this testing is reported below in the Table, below.

| Sample I. D. | Total Sample Weight (g) | Actual Sample Weight (g) | Water Absorbed (g) 1.2 sec | Water Absorbed (g) 2.4 sec | Rate (g/sec) | Normalized Rate ($g/g^4$ sec) | Water Absorbed (g) 1 min | Water Absorbed (g) 2 min | Normalized Water Absorbed (g water/g wiper) 1 min | Normalized Water Absorbed (g water/g wiper) 2 min | Average Normalized Rate ($g/g^4$ sec) | Decrease in Average Normalized Rate (%) | Averaged Normalized Water Absorbed (g) 1 min | Averaged Normalized Water Absorbed (g) 2 min | Decrease in Average Normalized Water Absorbed in Grams At 1 Min. (%) | Decrease in Average Normalized Water Absorbed in Grams At 2 Min. (%) |
|---|---|---|---|---|---|---|---|---|---|---|---|---|---|---|---|---|
| UT-1(a) | 1.20 | 1.17 | 0.50 | 1.00 | 0.417 | 0.357 | 3.20 | 3.80 | 2.74 | 3.26 | 0.398 | NA | 2.84 | 3.40 | NA | NA |
| UT-2(a) | 1.08 | 1.05 | 0.45 | 1.00 | 0.417 | 0.398 | 3.12 | 3.70 | 2.98 | 3.53 | | | | | | |
| UT-3(a) | 1.13 | 1.10 | 0.40 | 1.10 | 0.458 | 0.418 | 3.20 | 3.87 | 2.92 | 3.53 | | | | | | |
| UT-4(a) | 1.13 | 1.10 | 0.40 | 1.00 | 0.458 | 0.418 | 2.97 | 3.62 | 2.71 | 3.30 | | | | | | |
| UT-1(b) | 1.20 | 1.17 | 0.20 | 0.70 | 0.292 | 0.250 | 2.20 | 2.70 | 1.89 | 2.31 | 0.245 | 38 | 1.93 | 2.37 | 32 | 30 |
| UT-2(b) | 1.08 | 1.05 | 0.30 | 0.70 | 0.292 | 0.279 | 2.25 | 2.70 | 2.15 | 2.58 | | | | | | |
| UT-3(b) | 1.13 | 1.10 | 0.23 | 0.68 | 0.283 | 0.258 | 2.25 | 2.78 | 2.03 | 2.53 | | | | | | |
| UT-4(b) | 1.11 | 1.08 | 0.00 | 0.50 | 0.208 | 0.193 | 1.80 | 2.20 | 1.67 | 2.04 | | | | | | |
| UT-1(c) | 1.20 | 1.17 | 0.00 | 0.00 | 0.000 | 0.000 | 0.00 | 0.00 | 0.00 | 0.00 | 0.048 | 88 | 0.93 | 1.18 | 67 | 65 |
| UT-2(c) | 1.10 | 1.07 | 0.00 | 0.20 | 0.083 | 0.078 | 1.50 | 1.90 | 1.41 | 1.78 | | | | | | |
| UT-3(c) | 1.15 | 1.12 | 0.00 | 0.00 | 0.000 | 0.000 | 1.15 | 1.46 | 1.03 | 1.31 | | | | | | |
| UT-4(c) | 1.13 | 1.10 | 0.00 | 0.30 | 0.125 | 0.114 | 1.40 | 1.77 | 1.28 | 1.61 | | | | | | |
| UT-1(d) | 1.20 | 1.17 | 0.00 | 0.00 | 0.000 | 0.000 | 0.00 | 0.00 | 0.00 | 0.00 | 0.000 | 100 | 0.71 | 0.87 | 75 | 74 |
| UT-2(d) | 1.08 | 1.05 | 0.00 | 0.00 | 0.000 | 0.000 | 0.72 | 0.95 | 0.69 | 0.91 | | | | | | |
| UT-3(d) | 1.13 | 1.10 | 0.00 | 0.00 | 0.000 | 0.000 | 1.15 | 1.40 | 1.05 | 1.28 | | | | | | |
| UT-4(d) | 1.11 | 1.08 | 0.00 | 0.00 | 0.000 | 0.000 | 1.18 | 1.40 | 1.10 | 1.30 | | | | | | |
| 25-1(a) | 0.92 | 0.89 | 0.60 | 1.10 | 0.458 | 0.516 | 3.10 | 3.70 | 3.49 | 4.17 | 0.478 | NA | 3.51 | 4.16 | NA | NA |
| 25-2(a) | 0.99 | 0.96 | 0.60 | 1.10 | 0.458 | 0.479 | 3.15 | 3.75 | 3.29 | 3.92 | | | | | | |
| 25-3(a) | 0.98 | 0.95 | 0.80 | 1.00 | 0.417 | 0.440 | 3.55 | 4.15 | 3.75 | 4.38 | | | | | | |
| 25-1(b) | 0.95 | 0.92 | 0.95 | 1.20 | 0.500 | 0.545 | 3.15 | 3.70 | 3.44 | 4.03 | 0.536 | 0 | 3.28 | 3.86 | 7 | 7 |
| 25-2(b) | 0.97 | 0.94 | 0.75 | 1.15 | 0.479 | 0.511 | 2.95 | 3.50 | 3.15 | 3.74 | | | | | | |
| 25-3(b) | 0.92 | 0.89 | 0.65 | 1.17 | 0.488 | 0.550 | 2.88 | 3.38 | 3.25 | 3.81 | | | | | | |
| 25-1(c) | 0.92 | 0.89 | 0.68 | 1.08 | 0.450 | 0.507 | 2.84 | 3.35 | 3.20 | 3.78 | 0.470 | 2 | 3.00 | 3.56 | 15 | 14 |
| 25-2(c) | 0.98 | 0.95 | 0.68 | 1.05 | 0.438 | 0.463 | 2.70 | 3.22 | 2.85 | 3.40 | | | | | | |
| 25-3(c) | 0.98 | 0.95 | 0.53 | 1.00 | 0.417 | 0.440 | 2.78 | 3.32 | 2.94 | 3.51 | | | | | | |
| 25-1(d) | 0.95 | 0.92 | 0.50 | 0.85 | 0.354 | 0.386 | 2.30 | 2.77 | 2.51 | 3.02 | 0.458 | 4 | 2.76 | 3.30 | 21 | 21 |
| 25-2(d) | 0.91 | 0.88 | 0.49 | 1.00 | 0.417 | 0.475 | 2.51 | 2.99 | 2.36 | 3.41 | | | | | | |
| 25-3(d) | 0.97 | 0.94 | 0.65 | 1.15 | 0.479 | 0.511 | 2.72 | 3.24 | 2.90 | 3.46 | | | | | | |
| 50-1(a) | 1.10 | 1.07 | 0.80 | 1.20 | 0.500 | 0.469 | 3.50 | 4.20 | 3.28 | 3.94 | 0.396 | NA | 3.31 | 3.96 | NA | NA |
| 50-2(a) | 1.08 | 1.05 | 0.60 | 1.00 | 0.417 | 0.398 | 3.42 | 4.10 | 3.27 | 3.92 | | | | | | |
| 50-3(a) | 1.07 | 1.04 | 0.60 | 0.80 | 0.333 | 0.321 | 3.50 | 4.18 | 3.38 | 4.03 | | | | | | |
| 50-1(b) | 1.03 | 1.00 | 0.60 | 1.10 | 0.458 | 0.459 | 3.10 | 3.72 | 3.11 | 3.73 | 0.448 | 0 | 2.92 | 3.51 | 12 | 11 |
| 50-2(b) | 1.07 | 1.04 | 0.63 | 1.13 | 0.471 | 0.454 | 2.84 | 3.44 | 2.74 | 3.32 | | | | | | |
| 50-3(b) | 1.10 | 1.07 | 0.60 | 1.10 | 0.458 | 0.429 | 3.10 | 3.70 | 2.91 | 3.47 | | | | | | |
| 50-1(c) | 1.11 | 1.08 | 0.61 | 1.09 | 0.454 | 0.422 | 2.82 | 3.40 | 2.62 | 3.16 | 0.432 | 0 | 2.67 | 3.20 | 19 | 19 |
| 50-2(c) | 1.08 | 1.05 | 0.62 | 1.20 | 0.500 | 0.478 | 2.75 | 3.41 | 2.63 | 3.26 | | | | | | |
| 50-3(c) | 1.08 | 1.05 | 0.43 | 1.00 | 0.417 | 0.398 | 2.88 | 3.33 | 2.75 | 3.18 | | | | | | |
| 50-1(d) | 1.10 | 1.07 | 0.53 | 0.90 | 0.375 | 0.351 | 2.50 | 3.02 | 2.34 | 2.83 | 0.372 | 6 | 2.42 | 2.96 | 27 | 25 |
| 50-2(d) | 1.05 | 1.02 | 0.45 | 0.90 | 0.375 | 0.369 | 2.45 | 3.06 | 2.41 | 3.01 | | | | | | |
| 50-3(d) | 1.03 | 1.00 | 0.47 | 0.95 | 0.396 | 0.397 | 2.50 | 3.04 | 2.51 | 3.05 | | | | | | |
| 100-1(a) | 1.02 | 0.99 | 0.65 | 1.08 | 0.450 | 0.456 | 3.42 | 4.08 | 3.47 | 4.13 | 0.469 | NA | 3.42 | 4.07 | NA | NA |
| 100-2(a) | 1.10 | 1.07 | 0.65 | 1.05 | 0.450 | 0.422 | 3.52 | 4.20 | 3.30 | 3.94 | | | | | | |
| 100-3(a) | 1.07 | 1.04 | 0.72 | 1.32 | 0.550 | 0.530 | 3.63 | 4.30 | 3.50 | 4.15 | | | | | | |
| 100-1(b) | 1.05 | 1.02 | 0.75 | 1.20 | 0.500 | 0.492 | 3.10 | 3.65 | 3.05 | 3.59 | 0.428 | 9 | 2.88 | 3.41 | 16 | 16 |
| 100-2(b) | 1.09 | 1.06 | 0.51 | 0.81 | 0.338 | 0.320 | 2.70 | 3.23 | 2.55 | 3.06 | | | | | | |
| 100-3(b) | 1.00 | 0.97 | 0.30 | 1.10 | 0.458 | 0.474 | 2.93 | 3.48 | 3.03 | 3.60 | | | | | | |
| 100-1(c) | 1.02 | 0.99 | 0.40 | 0.90 | 0.375 | 0.380 | 2.38 | 3.40 | 2.92 | 3.44 | 0.396 | 16 | 2.76 | 3.28 | 19 | 19 |
| 100-2(c) | 1.10 | 1.07 | 0.40 | 0.92 | 0.383 | 0.359 | 2.82 | 3.35 | 2.64 | 3.14 | | | | | | |

-continued

| Sample I. D. | Total Sample Weight (g) | Actual Sample Weight (g) | Water Absorbed (g) 1.2 sec | Water Absorbed (g) 2.4 sec | Rate (g/sec) | Normalized Rate ($g/g^4$ sec) | Water Absorbed (g) 1 min | Water Absorbed (g) 2 min | Normalized Water Absorbed (g water/g wiper) 1 min | Normalized Water Absorbed (g water/g wiper) 2 min | Average Normalized Rate ($g/g^4$ sec) | Decrease in Average Normalized Rate (%) | Averaged Normalized Water Absorbed (g) 1 min | Averaged Normalized Water Absorbed (g) 2 min | Decrease in Average Normalized Water Absorbed in Grams At 1 Min. (%) | Decrease in Average Normalized Water Absorbed in Grams At 2 Min. (%) |
|---|---|---|---|---|---|---|---|---|---|---|---|---|---|---|---|---|
| 100-3(c) | 1.05 | 1.02 | 0.55 | 1.10 | 0.458 | 0.450 | 2.77 | 3.32 | 2.72 | 3.26 | | | | | | |
| 100-1(d) | 1.00 | 0.97 | 0.40 | 0.90 | 0.375 | 0.388 | 2.60 | 3.10 | 2.69 | 3.21 | 0.413 | 12 | 2.65 | 3.15 | 23 | 23 |
| 100-2(d) | 1.08 | 1.05 | 0.40 | 0.92 | 0.383 | 0.366 | 2.65 | 3.15 | 2.53 | 3.01 | | | | | | |
| 100-3(d) | 1.02 | 0.99 | 0.57 | 1.15 | 0.479 | 0.485 | 2.68 | 3.20 | 2.72 | 3.24 | | | | | | |
| 300-1(a) | 1.01 | 0.98 | 0.80 | 1.31 | 0.546 | 0.559 | 3.30 | 3.90 | 3.38 | 3.99 | 0.476 | NA | 3.30 | 3.96 | NA | NA |
| 300-2(a) | 1.00 | 0.97 | 0.53 | 1.08 | 0.450 | 0.465 | 3.15 | 3.75 | 3.26 | 3.88 | | | | | | |
| 300-3(a) | 0.98 | 0.95 | 0.52 | 0.92 | 0.383 | 0.404 | 3.10 | 3.80 | 3.27 | 4.01 | | | | | | |
| 300-1(b) | 0.96 | 0.93 | 0.64 | 1.10 | 0.458 | 0.494 | 2.52 | 3.00 | 2.72 | 3.24 | 0.547 | 0 | 2.95 | 3.47 | 11 | 12 |
| 300-2(b) | 0.99 | 0.96 | 0.80 | 1.40 | 0.583 | 0.609 | 3.01 | 3.52 | 3.15 | 3.68 | | | | | | |
| 300-3(b) | 1.00 | 0.97 | 0.80 | 1.25 | 0.521 | 0.539 | 2.88 | 3.38 | 2.98 | 3.50 | | | | | | |
| 300-1(c) | 1.00 | 0.97 | 0.00 | 0.68 | 0.258 | 0.267 | 2.28 | 2.75 | 2.36 | 2.84 | 0.351 | 26 | 2.50 | 3.01 | 24 | 24 |
| 300-2(c) | 1.00 | 0.97 | 0.00 | 0.80 | 0.333 | 0.344 | 2.45 | 2.97 | 2.53 | 3.07 | | | | | | |
| 300-3(c) | 0.98 | 0.95 | 0.30 | 1.00 | 0.417 | 0.440 | 2.47 | 2.94 | 2.61 | 3.10 | | | | | | |
| 300-1(d) | 1.00 | 0.97 | 0.40 | 0.90 | 0.375 | 0.388 | 2.48 | 2.99 | 2.56 | 3.09 | 0.449 | 6 | 2.72 | 3.23 | 18 | 18 |
| 300-2(d) | 0.98 | 0.95 | 0.30 | 1.02 | 0.425 | 0.449 | 2.66 | 3.12 | 2.81 | 3.29 | | | | | | |
| 300-3(d) | 0.95 | 0.92 | 0.54 | 1.12 | 0.467 | 0.509 | 2.56 | 2.04 | 2.79 | 3.32 | | | | | | |
| 400-1(a) | 1.08 | 1.05 | 0.72 | 1.25 | 0.521 | 0.498 | 3.35 | 3.95 | 3.20 | 3.77 | 0.480 | NA | 3.23 | 3.83 | NA | NA |
| 400-2(a) | 1.08 | 1.05 | 0.70 | 1.32 | 0.550 | 0.525 | 3.42 | 4.04 | 3.27 | 3.86 | | | | | | |
| 400-3(a) | 1.08 | 1.05 | 0.50 | 1.05 | 0.438 | 0.418 | 3.37 | 4.04 | 3.22 | 3.86 | | | | | | |
| 400-1(b) | 1.08 | 1.05 | 0.23 | 0.80 | 0.333 | 0.318 | 2.50 | 3.10 | 2.39 | 2.96 | 0.276 | 43 | 2.30 | 2.82 | 29 | 26 |
| 400-2(b) | 1.06 | 1.03 | 0.00 | 0.55 | 0.229 | 0.223 | 2.15 | 2.67 | 2.09 | 2.60 | | | | | | |
| 400-3(b) | 1.08 | 1.05 | 0.14 | 0.72 | 0.300 | 0.287 | 2.52 | 3.02 | 2.41 | 2.88 | | | | | | |
| 400-1(c) | 1.08 | 1.05 | 0.52 | 0.94 | 0.392 | 0.374 | 2.24 | 2.62 | 2.14 | 2.50 | 0.209 | 56 | 1.77 | 2.18 | 45 | 43 |
| 400-2(c) | 1.08 | 1.05 | 0.00 | 0.00 | 0.000 | 0.000 | 1.22 | 1.62 | 1.17 | 1.55 | | | | | | |
| 400-3(c) | 1.10 | 1.07 | 0.00 | 0.65 | 0.271 | 0.254 | 2.15 | 2.65 | 2.01 | 2.48 | | | | | | |
| 400-1(d) | 1.05 | 1.02 | 0.45 | 0.80 | 0.333 | 0.327 | 2.50 | 2.97 | 2.46 | 2.92 | 0.306 | 36 | 2.21 | 2.66 | 32 | 31 |
| 400-2(d) | 1.05 | 1.02 | 0.40 | 0.95 | 0.396 | 0.389 | 2.31 | 2.77 | 2.27 | 2.72 | | | | | | |
| 400-3(d) | 1.09 | 1.06 | 0.80 | 0.51 | 0.212 | 0.201 | 2.01 | 2.46 | 1.90 | 2.33 | | | | | | |
| 600-1(a) | 1.05 | 1.02 | 0.75 | 1.20 | 0.500 | 0.492 | 3.12 | 3.74 | 3.07 | 3.68 | 0.459 | NA | 3.22 | 3.81 | NA | NA |
| 600-2(a) | 1.05 | 1.02 | 0.55 | 1.05 | 0.438 | 0.431 | 3.35 | 3.97 | 3.29 | 3.90 | | | | | | |
| 600-3(a) | 1.02 | 0.99 | 0.68 | 1.08 | 0.450 | 0.456 | 3.26 | 3.80 | 3.30 | 3.85 | | | | | | |
| 600-1(b) | 1.01 | 0.98 | 0.39 | 0.99 | 0.412 | 0.422 | 2.80 | 3.31 | 2.87 | 3.39 | 0.395 | 14 | 2.65 | 3.18 | 18 | 17 |
| 600-2(b) | 1.01 | 0.98 | 0.29 | 0.89 | 0.371 | 0.380 | 2.58 | 3.10 | 2.64 | 3.17 | | | | | | |
| 600-3(b) | 1.01 | 0.98 | 0.40 | 0.90 | 0.375 | 0.384 | 2.40 | 2.91 | 2.46 | 2.98 | | | | | | |
| 600-1(c) | 1.05 | 1.02 | 0.00 | 0.00 | 0.000 | 0.000 | 0.00 | 0.00 | 0.00 | 0.00 | 0.029 | 94 | 1.02 | 1.31 | 68 | 66 |
| 600-2(c) | 1.00 | 0.97 | 0.00 | 0.05 | 0.021 | 0.022 | 1.45 | 1.87 | 1.50 | 1.93 | | | | | | |
| 600-3(c) | 1.00 | 0.97 | 0.00 | 1.15 | 0.062 | 0.064 | 1.52 | 1.92 | 1.57 | 1.99 | | | | | | |
| 600-1(d) | 1.00 | 0.97 | 0.00 | 0.00 | 0.000 | 0.000 | 0.00 | 0.21 | 0.00 | 0.22 | 0.033 | 93 | 1.01 | 1.37 | 69 | 64 |
| 600-2(d) | 1.01 | 0.98 | 0.00 | 0.00 | 0.000 | 0.000 | 0.95 | 1.30 | 0.97 | 1.33 | | | | | | |
| 600-3(d) | 1.00 | 0.97 | 0.00 | 0.45 | 0.095 | 0.098 | 2.00 | 2.48 | 2.07 | 2.56 | | | | | | |

The data of Table I may be interpreted as follows; (1) UT represents the non-corona treated samples whereas the 25, 50, 100, 300, 400, 600 represents the feet per minute of the web as it passed through the corona discharge gap; (2) three replicate samples of each treated material were taken with each of these being represented by the number 1 or 2 of 3; (3) each of the samples was subjected to testing in accordance with Test A four times with the first test being designated by the letter (a) the second represented by the letter (b) the third being represented by the letter (c) and the fourth being represented by the letter (d). Thus 600−3(d) stands for the results of the fourth time the third replicate sample of material treated at 600 feet per minute was tested in accordance with Test A.

From the above results reported in Table I, it is clear that materials treated in accordance with our invention line speeds of about 400 feet per minute or less (about 0.8 watt-min. per square foot per side or greater) have significantly smaller decreases in average normalized rate of water acquision and in averaged normalized water absorbed at one minute and two minutes. Such materials can be repeatedly reused as wiper materials helping both the environment because of less wipers being used and the user because less materials may be purchased.

While the invention has been described in detail with respect to specific embodiments thereof, it will be appreciated that those skilled in the art, upon attaining an understanding of the foregoing, may readily conceive of alterations to and variations of these embodiments. Such alterations and variations are believed to fall within the scope and spirit of the invention and the appended claims.

What is claimed is:

1. A method of treating a high hydrohead fibrous porous web comprising the steps of:

providing a high hydrohead fibrous porous web having, a surface concentration of at least about 0.05 percent, by weight of the web, of a surface active agent having a hydrophile-lipophile balance of at least about 6; and applying a corona discharge equivalent to a charge of at least about 0.8 watt minute per square foot per side of the web to the surface active agent bearing web; and wherein the resulting web has a percent decrease in the averaged normalized water absorbed, at two minutes, of less than about 50 weight percent in each of the second, third and fourth times the material is tested in accordance with absorbency test A when compared to the averaged normalized water absorbed upon being initially tested in accordance with absorbency test A.

2. The method of claim 1, wherein the surface concentration of the surface active agent is from about 0.05% to about 3%, by weight of the web material.

3. The method of claim 1, wherein the surface concentration of the surface active agent is from about 0.1% to about 1% by weight of the web material.

4. The method of claim 1, wherein the surface concentration of the surface active agent is from about 0.1% to about 0.4%, by weight of the web material.

5. The method of claim 1, wherein the surface concentration of the surface active agent is from about 0.2% to about 0.3%, by weight of the web material.

6. The method of claim 1, wherein the equivalent of from about 0.8 to about 15 watt minute per square foot per side of the web material of corona discharge is applied to the web material.

7. The method of claim 1, wherein the equivalent of from about 1 to about 10 watt minute per square foot per side of the web material of corona discharge is applied to the web material.

8. The method of claim 1, wherein the equivalent of from about 2 to about 8 watt minute per square foot per side of the web material of corona discharge is applied to the web material.

9. The method of claim 1, wherein the surface active agent is selected from the group consisting of one or more wetting agents, emulsions and detergents.

10. The method of claim 1, wherein the surface active agent is a wetting agent.

11. The method of claim 1, wherein the surface active agent is an emulsion.

12. The method of claim 1, wherein the surface active agent is a detergent.

13. The product by the process of claim 1.

14. The product preparable by the process of claim 1.

15. A method of treating a high hydrohead fibrous porous web comprising the steps of:

providing a high hydrohead fibrous porous web having, a surface concentration of at least about 0.05 percent, by weight of the web, of a surface active agent having a hydrophile-lipophile balance of at least about 6; and applying a corona discharge equivalent to a charge of at least about 0.8 watt minute per square foot per side of the web to the surface active agent bearing web; and wherein the resulting web has a percent decrease in the averaged normalized water absorbed, at two minutes, of less than about 25 weight percent in each of the second, third and fourth times the material is tested in accordance with absorbency test A when compared to the averaged normalized water absorbed upon being initially tested in accordance with absorbency test A.

16. The product prepared by the process of claim 15.

17. The product preparable by the process of claim 15.

18. A method of treating a high hydrohead fibrous porous web comprising the steps of:

providing a high hydrohead fibrous porous web having, a surface concentration of at least about 0.05 percent, by weight of the web, of a surface active agent having a hydrophile-lipophile balance of at least about 6; and applying a corona discharge equivalent to a charge of at least about 0.8 watt minute per square foot per side of the web to the surface active agent bearing web; and wherein the resulting web has a percent decrease in the averaged normalized rate of water absorbed, in the first 2.4 seconds of absorption, of less than about 50 percent in each of the second, third and fourth times the material is tested in accordance with absorbency test A when compared to the averaged normalized rate of water absorbed upon being initially tested in accordance with absorbency test A.

19. The product prepared by the process of claim 18.

20. The product preparable by the process of claim 18.

21. A method of treating a high hydrohead fibrous porous web comprising the steps of:

providing a high hydrohead fibrous porous web having, a surface concentration of at least about 0.05 percent, by weight of the web, of a surface active agent having a hydrophile-lipophile balance of at least about 6; and applying a corona discharge equivalent to a charge of at least about 0.8 watt minute per square foot per side of the web to the surface active agent bearing web; and wherein the resulting web has a percent decrease in the averaged normalized rate of water absorbed, in the first 2.4 seconds of absorption, of less than about 25 percent in each of the second, third and fourth times the material is tested in accordance with absorbency test A when compared to the averaged normalized rate of water absorbed upon being initially tested in accordance with absorbency test A.

22. The product prepared by the process of claim 21.

23. The product preparable by the process of claim 21.

24. A method of treating a high hydrohead fibrous porous web comprising the steps of:

providing a high hydrohead fibrous porous web having, a surface concentration of at least about 0.05 percent, by weight of the web, of a surface active agent having a hydrophile-lipophile balance of at least about 6; and applying a corona discharge equivalent to a charge of at least about 0.8 watt minute per square foot per side of the web to the surface active agent bearing web; and wherein the resulting web has a percent decrease in the averaged normalized rate of water absorbed, in the first 2.4 seconds of absorption, of less than about 10 percent in each of the second, third and fourth times the material is tested in accordance with absorbency test A when compared to the averaged normalized rate of water absorbed upon being initially tested in accordance with absorbency test A.

25. The product prepared by the process of claim 24.

26. The product preparable by the process of claim 24.

* * * * *

UNITED STATES PATENT AND TRADEMARK OFFICE

CERTIFICATE OF CORRECTION

PATENT NO. : 5,102,738

DATED : April 7, 1992

INVENTOR(S) : Anita S. Bell et al.

It is certified that error appears in the above-identified patent and that said Letters Patent is hereby corrected as shown below:

Column 1, line 25, "by by" should read --by--;

Column 2, line 6, "fibres" should read --fibers--; line 48, "any anyone" should read --anyone--;

Column 3, line 50, "then" should read --than--;

Column 5, line 38, "process" should read --porous--;

Column 7, line 31, "with out" should read --with our--;

Column 10, line 18, "Cyanamide" should read --Cyanamid--; line 31, "30" should read --330--;

Column 11, line 64, "of the surface" should read --of surface--;

Column 13, line 19, "0.3% by" should read --0.3%, by--;

Column 14, line 6, "percent of" should read --percent or--; line 21, "set a" should read --set at--;

Column 19, line 7, "2 of 3;" should read --2 or 3;--; line 60, "1% by" should read --1%, by--;

UNITED STATES PATENT AND TRADEMARK OFFICE

CERTIFICATE OF CORRECTION

PATENT NO. : 5,102,738

DATED : April 7, 1992

INVENTOR(S) : Anita S. Bell et al.

It is certified that error appears in the above-indentified patent and that said Letters Patent is hereby corrected as shown below:

Column 20, line 20, "product by" should read --product prepared by--.

Signed and Sealed this

Twelfth Day of October, 1993

*Attest:*

*Attesting Officer*

Bruce Lehman

BRUCE LEHMAN

*Commissioner of Patents and Trademarks*